US005507056A

United States Patent [19]

Brown

[11] Patent Number: 5,507,056

[45] Date of Patent: Apr. 16, 1996

[54] APPARATUS FOR FORM-FITTING SHOES, AND OTHER ARTICLES OF FOOTWEAR

[75] Inventor: Dennis N. Brown, Blaine, Wash.

[73] Assignee: Northwest Podiatric Laboratory, Inc., Blaine, Wash.

[21] Appl. No.: 442,978

[22] Filed: May 17, 1995

Related U.S. Application Data

[63] Continuation-in-part of Ser. No. 23,822, Jun. 1, 1994, Pat. No. Des. 360,816.

[51] Int. Cl.[6] ..... A43D 5/00

[52] U.S. Cl. ..... 12/114.2; 12/115.2; 12/114.4; 12/115.6; 12/116.8

[58] Field of Search ..... 12/114.2, 115.2, 12/114.4, 115.6, 116.8, 124, 53.6, 115.4, 119.5, 142 N

[56] References Cited

U.S. PATENT DOCUMENTS

| | | | |
|---|---|---|---|
| 653,575 | 7/1900 | Hall | 12/115.2 |
| 754,047 | 3/1904 | Burt et al. | 12/116.8 |
| 1,117,818 | 11/1914 | Ellmann | 12/115.2 |
| 2,673,360 | 3/1954 | Bascom | 12/114.2 |
| 4,060,869 | 12/1977 | Brown . | |
| 5,337,432 | 8/1994 | Pirhonen | 12/114.4 |

*Primary Examiner*—Paul T. Sewell
*Assistant Examiner*—Marie Denise Patterson
*Attorney, Agent, or Firm*—Todd N. Hathaway

[57] ABSTRACT

An apparatus for internally expanding an article of footwear. A hand-operated pressure assembly is provided, in which a knob is manually rotated in order to transversely extend first and second piston members. Hemispherical bearing surfaces on the ends of the piston members are received in corresponding receptacles formed in the legs of a hinged spreader assembly; as the pistons extend outwardly, the spreader assembly is forced against and stretches a selected interior portion of the article of footwear. Cupped overlay members are provided for detachable mounting to the legs of the spreader assembly so as to permit selective adjustment of its width to match that of the particular shoe or boot on which the work is being performed. Preferably, the hydraulic fluid which is used in the pressure assembly is ordinary tap water, so that leakage does not represent a hazard in a retail environment.

20 Claims, 4 Drawing Sheets

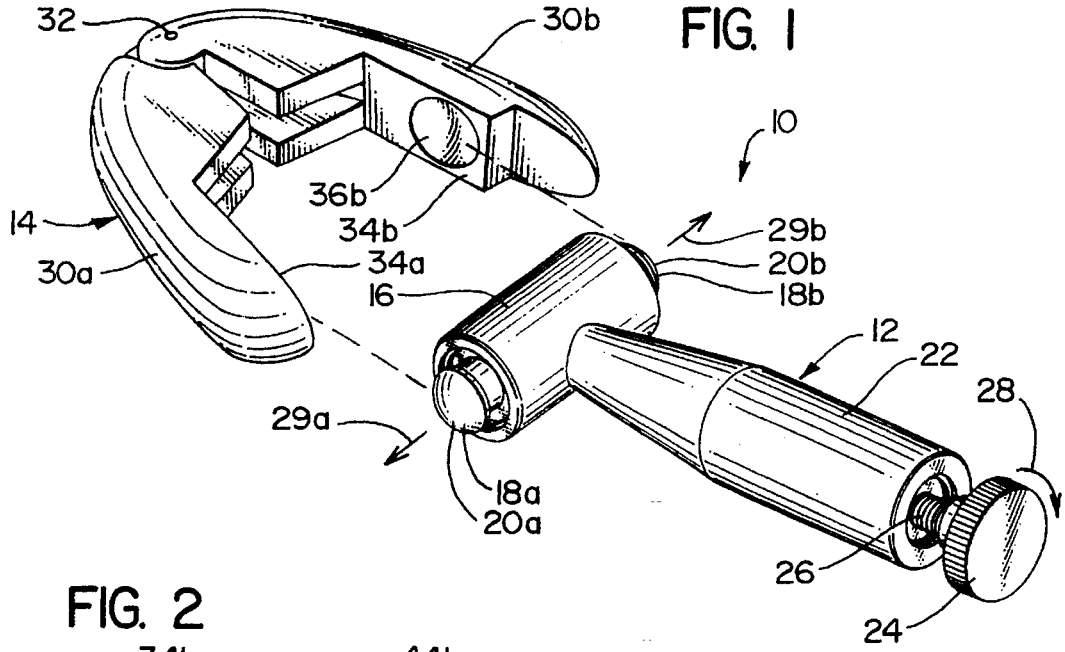
FIG. 1
FIG. 2
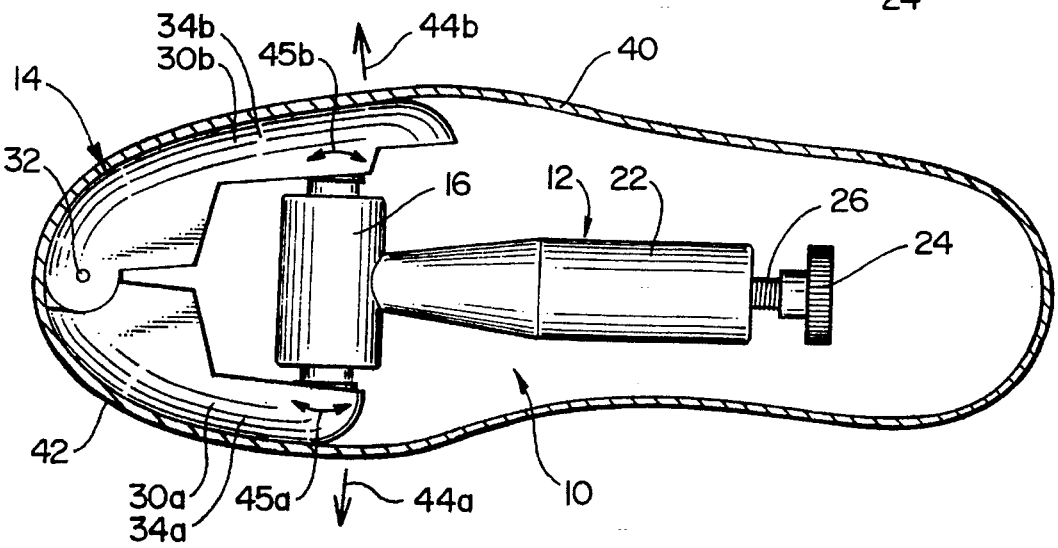
FIG. 3
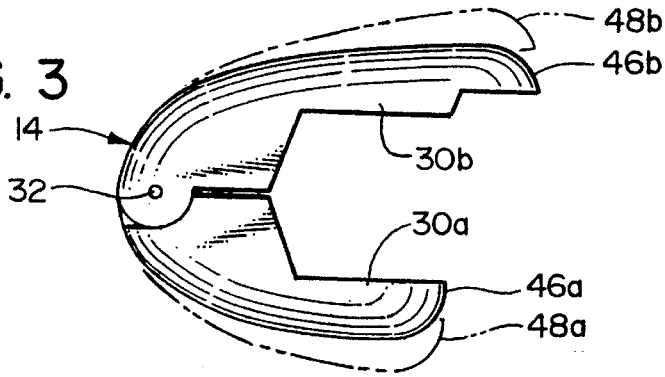

APPARATUS FOR FORM-FITTING SHOES, AND OTHER ARTICLES OF FOOTWEAR

This application is a Continuation-In-Part application of U.S. design application Ser. No. 29/023,822, entitled "SHOE AND BOOT EXPANDER", filed Jun. 1, 1994, now U.S. Pat. No. D 360,816.

FIELD OF THE INVENTION

The present invention relates generally to the form fitting of footwear, and more particularly, to an apparatus for locally enlarging shoes, boots, and other footwear so as to adapt the shape of the footwear to the foot of the user.

BACKGROUND OF THE INVENTION

Applicant's U.S. Pat. No. 4,060,869 (the '869 patent) discloses a hydraulically operated apparatus for permanently enlarging selected sections of footgear so as to accommodate the individual characteristics of the user's foot. The device comprises a generally cylindrical member having a bore which supports diametrically opposed domed members in a piston/cylinder relationship. Hydraulic pressure is supplied to the chamber intermediate the inner ends of the two pistons, so that the domed members are forced outwardly against selected portions of the interior of the article of footwear, deforming this so that it will better accommodate the user's foot. The end surfaces of the domed members are configured to bear directly against the interior surface of the shoe/boot, and the hydraulic pressure is supplied from a bench-operated reciprocating hydraulic pump (resembling a bottle jack), a compressed air cylinder, or a similar remote source.

The apparatus which is disclosed in the '869 patent has proven to be extremely effective and highly popular, especially for form-fitting ski boots. The device has been found particularly suitable for this type of service, in that, owing to the high pressures which can be generated by the hydraulic pump, compressed air cylinder or other remote source, it is capable of exerting the relatively high contact pressures which are required to stretch the comparatively rigid materials of which ski boots are constructed and also due to the fact that most such work is conducted in a workshop environment (i.e., in a ski shop) which ordinarily includes a workbench on which the hydraulic pump can be operated, and/or space in which a compressed air cylinder can be accommodated, and in which the slight leakages of conventional hydraulic fluid which occasionally accompany operation of the device do not present an unacceptable problem.

In other environments and applications, however, the device which is disclosed in the '869 patent has been found to have its limitations. For example, in a typical retail environment where men's/ladies' street shoes are sold, the presence/operation of a compressed gas cylinder or manually-reciprocated hydraulic pump is ordinarily inappropriate, and furthermore there is typically insufficient space in which to locate such pressure sources. Moreover, the leakage of oily hydraulic fluid, while perhaps acceptable in a shop environment, and to which synthetic ski boot materials are relative impervious, is highly objectionable in a retail setting. In short, the apparatus which is disclosed in the '869 patent is inappropriate or at least inconvenient for use on the sales floor of a typical shoe store.

Furthermore, the street shoes which are usually sold in such environments do not require the same level of stretching pressure as do ski boots. For example, the relatively thin leather of a lady's high-heeled shoe can be permanently deformed by the application of contact pressures which are far lower than those which are required to stretch an ordinary ski boot. Moreover, the permanent deformation of relatively lightweight leathers usually does not require the same application of heat as is needed for the relatively stiff materials of which ski boots and other relatively heavyweight footwear are constructed (e.g., see FIG. 3 of the '869 patent).

Another limitation of the device which is disclosed in the '869 patent is that it exerts pressure only over a relatively limited, generally oval area which is defined by the contact surface of the domed piston member. This suffices in many cases where comparatively high contact pressures need to be concentrated at a particular point on the user's foot (at the location of an ankle bone, for example), such as are commonly encountered with ski boots. By contrast, a more widely distributed pressure is typically needed when working with street or dress shoes, where a more generalized area of the shoe usually needs to be enlarged, such as across the toe box or arch, or heel areas (the first being the more common situation).

Another relevant factor is that the widths of the shoes which are on sale in a typical retail environment usually vary over a relatively large range, whereas the maximum variation in the width between the domed members of the device which is disclosed in the '869 patent is limited to the combined travel of the piston members; this makes it difficult or impossible for the device to accommodate the full range of shoe size which are commonly on hand, particularly since the angle at which the axes of the domed pistons intercept the interior walls of the shoes tends to vary greatly with the width, especially (for example) in the tapering toe box area. A related deficiency of the prior device is that any pivoting movement of the knurled surface of the domed members which occurs as the pistons extend tends to cause significant abrasion or damage to the interior of the shoe, particularly if this is formed of a soft liner leather of the type which are commonly used in dress shoes.

Accordingly, there exists a need for a compact stretching tool which can be used in a retail or similar environment, to enlarge predetermined areas of shoes and other footwear so as to accommodate the requirements of the individual user's feet. Moreover, there is a need for such an apparatus which can be conveniently adapted to work with shoes having a wide range of sizes and widths, and which can distribute the stretching force over a relatively large internal area of the shoe. Still further, there is a need for such a tool which can function without the possibility of leaking hydraulic fluid or other material which would be objectionable in a retail environment.

SUMMARY OF THE INVENTION

The present invention has solved the problems cited above, and is an apparatus for internally expanding an article of footwear, in which the apparatus broadly comprises: (a) a pressure assembly comprising: a fluid pressure cylinder portion; a piston member mounted in the cylinder portion for reciprocation therein; a first engagement member formed on an outer end of the piston member; a second engagement member formed on a side of the cylinder portion opposite the first engagement member so as to be spaced apart therefrom by predetermined separation distance; and means for fluid pressure to the cylinder portion so as to selectively extend the piston member; and (b) a spreader assembly comprising: first and second mandrels for engaging first and second sides of the interior portion of the article of footwear and having rearwardly-extending leg members; hinge means for joining the first end portions of the leg members proximate a first end of the spreader assembly so that the leg members extend therefrom to form a gap intermediate the second ends thereof; and receptacle portions formed in the second end portions of the leg members so as to be positioned on opposite sides of the gap for receiving the first and second engagement portions of the pressure assembly; whereby, in response to selectively supplying fluid pressure to the cylinder portion, the piston member extends therefrom so as to increase the separation distance between the first and second engagement members on the pressure assembly, so that the engagement members which are received in the receptacle portions of the leg members force the mandrel members outwardly about the hinge means so as to internally expand the interior portion of the article of footwear.

The apparatus may further comprise bearing means for permitting pivoting movement of the leg members of the spreader assembly relative to an axis of the cylinder portion of the pressure assembly as the mandrel members spread apart. The bearing means may comprise a bearing interface formed between at least one of the engagement members on the pressure assembly and the receptacle portion in the leg member. Preferably, the bearing interface may comprise a smooth, convex, generally hemispherical surface formed on an outer end of the piston member, and a smooth, concave, generally hemispherical surface formed in the receptacle portion of the leg member.

The pressure assembly may further comprise a second piston member mounted in the cylinder portion for reciprocation therein in a direction opposite that of the first piston member, and having a second engagement member formed on an outer end thereof. The means for supplying pressure to the cylinder portion, in turn, may comprise: a hydraulic fluid reservoir; piston means for selectively displacing the hydraulic fluid out of the reservoir under pressure; and a conduit for supplying the hydraulic fluid which is forced out of the reservoir to the cylinder portion so that the first and second piston members are selectively forced outwardly therefrom.

The hydraulic fluid reservoir may comprise a substantially cylindrical chamber having a long axis along which the piston means travels so as to displace the fluid from the chamber. The pressure assembly, in turn, may further comprise an elongate handle portion which encloses the cylindrical chamber of the hydraulic reservoir, and which extends generally perpendicularly from the cylinder portion so as to form a hand grip to assist an operator in holding the assembly. The piston means for selectively displacing the hydraulic fluid out of the reservoir may comprise: an elongate threaded member having an inner end mounted to a drive piston in the cylindrical chamber, and an outer end which extends axially out of the rearward end of the handle portion and is in threaded engagement therewith; and a knob member mounted to the outer end of the threaded member, the knob member being configured to permit the operator to selectively displace the hydraulic fluid out of the reservoir by rotating the knob member with the fingers of a first hand while holding the handle portion with the fingers of a second hand. Preferably, the handle portion is sized to have sufficient length to extend from proximate the selected interior portion of the article of footwear to proximate the ankle opening thereof, so as to enable the operator to conveniently rotate the knob member with the fingers of a hand which extends through the ankle opening.

Preferably, each leg member of the mandrels comprises an inner surface having the receptacle portion formed therein, and a generally smooth, convex outer surface which is configured to engage a corresponding shaped inner surface of the selected interior portion of the article of footwear. Furthermore, the mandrel may further comprise at least one overlay member which is configured to be selectively fitted over the outer surface of the leg member of the mandrel member so as to selectively increase the effective size thereof. The overlay member may comprise: an elongate, cupped shell member of a predetermined thickness, the shell member having (a) a concave inner surface which corresponds to and detachably engages the convex outer surface of the leg member, and (b) a generally smooth, convex outer surface which is configured to engage a correspondingly shaped inner surface of the interior portion of a second article of footwear having an interior width which is larger than that of the first article. The concave inner surface of the cupped shell member may have an inner radius which is slightly smaller than the outer radius of the convex outer surface of the leg member, so that the shell member frictionally engages the outer surface of the leg member when fitted thereover.

The first and second mandrel members may each comprise a plurality of the shell members, these in combination providing the spreader assembly with a selectively adjustable range of widths which corresponds to a plurality of articles of footwear having a predetermined range of widths.

BRIEF DESCRIPTION OF THE DRAWINGS

FIG. 1 is a perspective view of the apparatus of the present invention, showing the hand-operated hydraulic pressure assembly in association with the hinged spreader assembly;

FIG. 2 is a plan view of the apparatus shown in FIG. 1, showing this disposed in a shoe for spreading the toe box thereof;

FIG. 3 is a plan view of the hinged spreader assembly of FIG. 2, showing this in a first angular position and a second, extended angular position which is indicated by the broken line image;

DETAILED DESCRIPTION a. Overview

Figure 4:
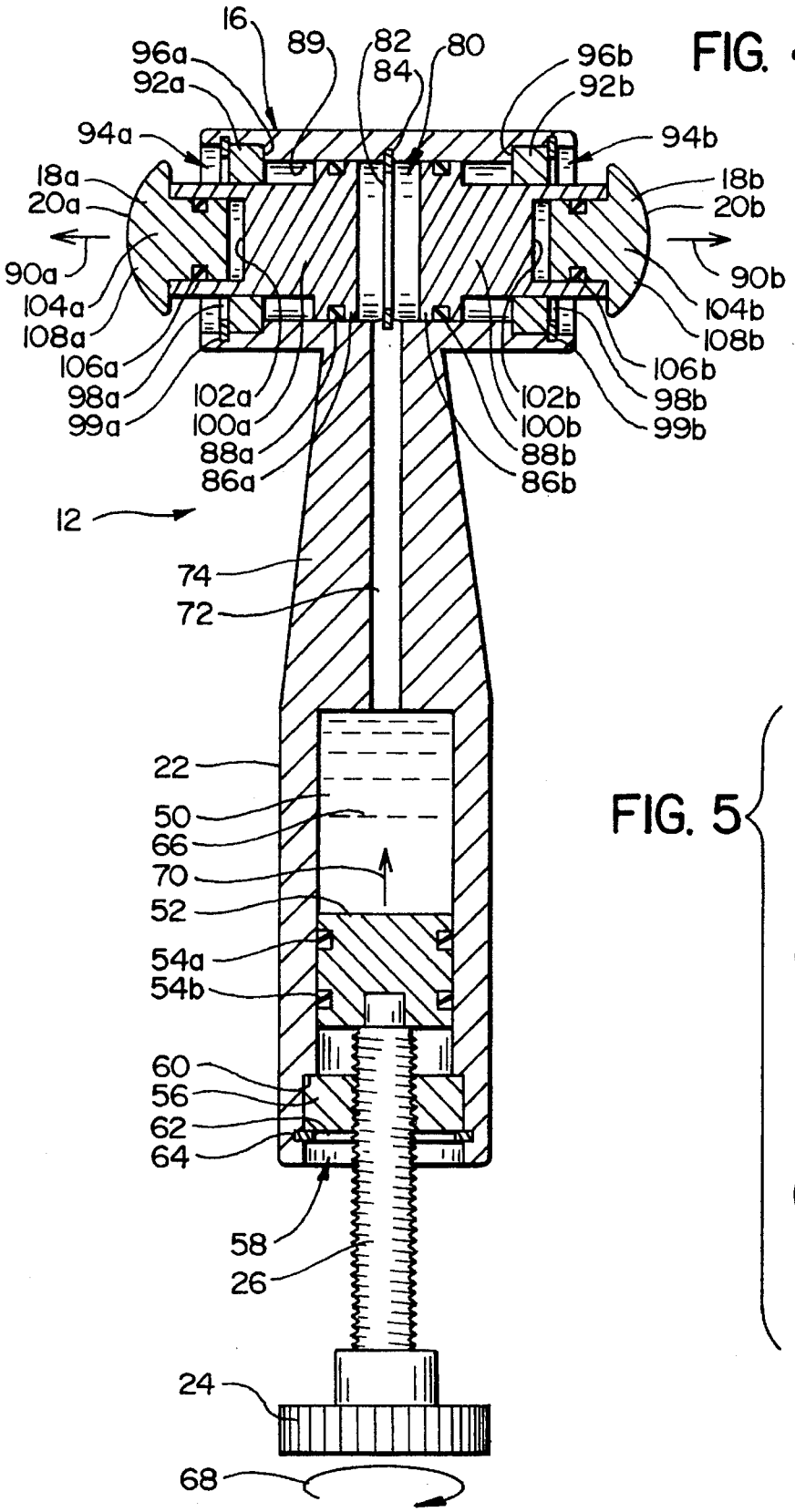
FIG. 4 is a sectional view of the pressure assembly of FIG. 2 showing the hand-operated drive piston which provides fluid pressure to the head of the device intermediate the two extensible piston members thereof.

FIG. 1 provides a perspective view of the expander system 10 of the present invention. As can be seen, this comprises two basic subassemblies: a hand-operated pressure assembly 12 and a contoured spreader assembly 14.

The pressure assembly 12 comprises a transversely extending cylinder portion 16 which supports first and second diametrically opposed piston members 18*a*, 18*b*, each of which has a hemispherically-convex bearing surface 20*a*, 20*b* formed on the outer end thereof. An elongate generally cylindrical grip portion 22 is mounted proximate the middle of the cylinder portion and extends perpendicularly therefrom.

A knurled operating knob 24 is mounted to a threaded shaft 26 which extends from the outer end of the hand grip portion (i.e., opposite the cylinder member). As will be described in greater detail below, manual rotation of the knob 24 in the direction indicated by arrow 28 drives a displacement piston through a hydraulic reservoir within the body of the handle portion, and the resulting fluid pressure is supplied to a central chamber in the cylinder portion 16 so as to force the two piston members 18*a*, 18*b* outwardly in the directions indicated by arrows 29*a*, 29*b*.

As the piston members 18*a*, 18*b* extend outwardly, they force apart the two mandrels 30*a*, 30*b* of the spreader assembly 14. The mandrels are joined together by a vertically extending hinge pin 32 at their forward ends, and the rearwardly extending leg members 34*a*, 34*b* of the mandrels are provided with generally concave recesses 36*a* (not shown in FIG. 1), 36*b* which correspond to and receive the hemispherically-domed surfaces 20*a*, 20*b* of the pressure assembly.

FIG. 2 shows the manner in which the expander system 10 is used to stretch and shape a shoe 40. In the exemplary embodiment which is illustrated, the spreader assembly 14 is configured to stretch the toe box 42 of the shoe; it will be understood, however, that the spreader assembly can be particularly configured for use with other parts of the shoe, for example, for use in the arch or heel areas.

As can be seen in FIG. 2, the expander system 10 is configured and sized to be received entirely within the interior of a shoe 40, with the spreader assembly 14 positioned in the toe box and the ends of the two piston members retained in the recesses in the two mandrels. The elongate grip portion 22 serves to position the knob 24 adjacent the ankle opening of the shoe, so that the operator can conveniently reach through the opening and rotate the knob in the manner described above. The resulting extension of the piston members causes the two mandrels 30*a*, 30*b* of the spreader assembly pivot apart about the hinge pin 32, in the directions indicated by the arrows 44*a*, 44*b*. As this is done, the hemispherical, surfaces 20*a*, 20*b* and corresponding recesses 36*a*, 36*b* interact in a manner similar to ball-and-socket joints. This permits the pivoting movement which necessarily develops between the two assemblies during expansion, as indicated by arrows 45*a*, 45*b*, to take place smoothly and without abrupt transitions. Furthermore, the ball-and-socket interface permits the operator to pivot the pressure assembly upwardly (i.e., around the long axis of the cylinder portion 16) so as to position knob 24 at an angle in which it is more conventionally turned by hand.

The mandrels of the spreader assembly distribute the stretching force over a relatively large area of the interior of the shoe, and the operator continues to apply pressure using knob 24 until the mandrels have been forced outwardly a sufficient distance to cause the desired degree of permanent deformation of the leather or other material. For example, FIG. 3 shows the mandrel portions 30*a*, 30*b* as these are positioned in an initial angular orientation, as indicated at 46*a*, 46*b*, and a second, spread apart orientation indicated at 48*a*, 48*b*. Moreover, because the two piston members share a central fluid chamber, the outward forces which are exerted by the two associated mandrels is relatively equal as they move apart.

As can be seen in FIGS. 1–3, the two mandrels 30*a*, 30*b* are preferably of unequal length, with the medial member being somewhat shorter and more strongly curved than the lateral; this configuration enables the correct shape of a normal foot/shoe in the toe box area, and the device can simply be flipped over for use alternatively in left-foot and right-foot applications.

It should also be noted that, while the pressure assembly 12 is especially configured for use with the spreader assembly 14, it can also be used independently to apply expansion pressure where this is needed at relatively small, precise areas, in a manner similar to that of the device which is disclosed in the '869 patent. For example, the hemispherical surfaces 20*a*, 20*b* of the piston members can be placed directly against the inner surface of the shoe so as to deform this outwardly in order to specifically relieve pressure on a corn, a bone, and so forth.

b. Pressure Assembly

FIG. 4 is a view of a cross-section taken lengthwise through the pressure assembly 12. As was noted above, the main structural members of the pressure assembly are the cylinder portion 16 and hand grip portion 22.

A cylinder bore 50 within the handle portion forms a hydraulic reservoir, and houses a drive piston 52. The piston 52 is mounted to the inner end of threaded drive shaft 26, and is provided with seal rings 54*a*, 54*b* which form a fluid-tight fit with the wall of the cylinder bore; the piston may be fixedly mounted to the end of the shaft, as shown, so that the piston rings rotate against the cylinder well, or a coupling may be provided so that the shaft rotates independently of the piston.

The threaded shaft extends through and engages an internally threaded bushing 56 which is fixedly mounted in the outer end of the handle portion; the mouth opening 58 which leads into cylinder 50 is counter-bored to form a shoulder 60 which abuts one side of bushing 56, and a snap ring 62 retained in an annular groove 64 abuts the opposite side of the bushing so as to firmly hold this in place. As was noted above, the operating knob 24 is mounted to the protruding end of shaft 26.

The threads of bushing 56 and shaft 26 are configured to provide a relatively liquid-tight seal, but to permit a small degree of air flow therethrough, so as to avoid development of a significant pressure differential across the bushing which could interfere with ease of operation; if desired, a small bleed hole can be provided for this purpose.

The reservoir which is provided by cylinder bore 50 is filled with a suitable hydraulic fluid 66: Because the assembly operates at relatively low pressures and without a reciprocating pump, the hydraulic fluid can be ordinary tap water, and this is preferred from the standpoint that any leakage from the assembly will not be detrimental in a retail store environment.

As knob 24 is rotated in a clockwise direction as indicated by arrow 68 (assuming a right-hand thread), this is translated by the threaded engagement with stationary bushing 56 to an inward, displacement movement of piston 52 through cylinder 50, as indicated by arrow 70. This forces the hydraulic fluid 66 under pressure through a bore 72 which extends through the tapered neck portion 74 of the hand grip. The fluid discharges from bore 72 into a chamber 80 which is formed centrally in cylinder portion 16, intermediate the inner ends of the two piston members 18*a*, 18*b*; a central snap ring 82 is retained in cylinder 16 in an annular groove 84, so as to prevent the inner ends of the piston members from blocking the discharge opening of the bore.

A radially extending crown portion 86*a*, 86*b* at the inner end of each piston member 18 carries an o-ring seal 88*a*, 88*b* which forms a fluid-tight fit with the cylinder wall 89. Thus, fluid pressure entering chamber 80 causes the piston members to be forced outwardly in diametrically opposite directions along the axis of the cylinder, as indicated by arrows 90*a*, 90*b*.

The outer ends of the two piston members are supported for axial sliding movement by smooth-bore bushings 92*a*, 92*b* which are mounted in the opposite mouth openings 94*a*, 94*b* of the cylinder member. Each mouth opening is counterbored to form a shoulder 96*a*, 96*b* which, in combination with a snap-ring 98*a*, 98*b* which is retained in an annular groove 99*a*, 99*b*, serves to hold the associated bushing in place.

Each piston member further comprises a generally cylindrical shank portion 100*a*, 100*b* which extends from the crown portion 86*a*, 86*b* to an outer socket portion 102*a*, 102*b*. The cylindrical inner ends of interchangeable plug members 104*a*, 104*b* are detachably received in sockets 102*a*, 102*b*, and are provided with annular o-rings 106*a*, 106*b* which form a friction fit therewith. The outer ends of the plug members, in turn, are provided with generally hemispherical head portions 108*a*, 108*b* which form the domed pressure surfaces 20*a*, 20*b*.

Figure 5:
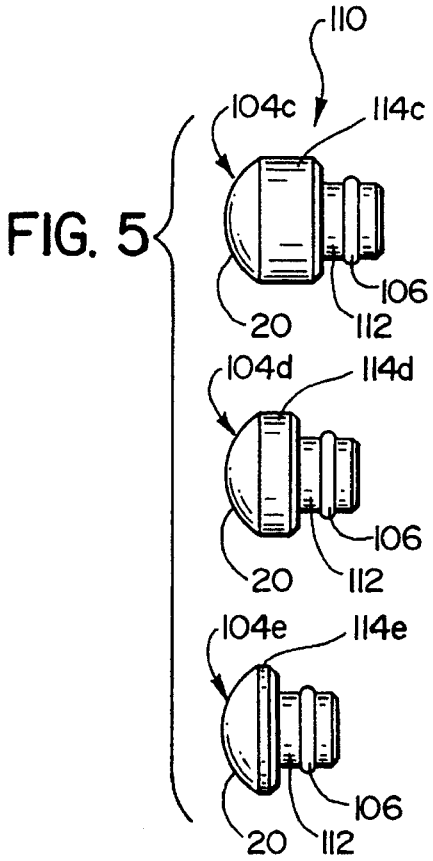
FIG. 5 is a plan view of a set of interchangeable plug members which provide the end surface of the piston members of the pressure assembly and permit selective adjustment of the distance between the end surfaces.

As is shown in FIG. 5, the interchangeable plug members 104 are preferably provided as a group or set 110 of such members having various lengths. In the embodiment which is illustrated, the domed surface portions 20, shaft portions 112, and o-ring 106 are identical for all of the interchangeable plug members 104*c–e*, the differences in overall length being provided by extension portions 114. For example, this varies in length from a relatively long extension portion 114*c* to a relatively short extension portion 114*e*; in the exemplary embodiment which is illustrated in FIG. 5, suitable overall lengths of the three plug members are ⅞, ⅝, and ½ inches, respectively.

This feature (i.e., a set of interchangeable plug members having a variety of lengths) provides the system with significantly enhanced flexibility. For example, referring again to FIG. 2, it will be understood by installing longer or shorter plug members in the socket portions of one or both of the piston members 18*a*, 18*b*, the system can be configured to match relatively wider or narrower shoes, or to accommodate shoes which have side walls which extend at differing angular orientations relative to one another, while keeping the alignment of the handle portion of the assembly generally parallel with the lengthwise axis of the shoe.

The embodiment of the pressure assembly which is illustrated in FIG. 4 may have the following exemplary dimensions:

| | |
|---|---|
| overall length, exclusive of drive knob | 4-⅞" |
| overall length with knob at outer stop | 6-⅛" |
| overall length with knob at inner stop | 5-¼" |
| reservoir diameter | ½" |
| length of piston travel in reservoir | ⅞" |
| outside diameter of handle portion | 1" |
| width of cylinder portion, exclusive of piston members | 1-11/16" |
| diameter of cylinder bore | ⅝" |
| overall length of cylinder bore | 1-3/16" |
| overall length of piston members, exclusive of plug member | ¾" |
| diameter of piston crown | ⅝" |
| diameter of piston shank | ½" |
| diameter of piston socket | ⅜" |
| diameter of plug member base | ⅜" |
| length of plug member base | 5/16" |
| overall length of plug members | see above |
| diameter of plug member head | ⅝" |
| hemispherical radius of plug member head | 11/16" |

The above dimensions are approximate, with adequate clearances being provided where necessary for operation of the assembly. The assembly may be formed of any suitable material, machined/brazed brass and other materials resistant to corrosion in use with tap water being eminently suitable for this purpose.

c. Spreader Assembly

As was noted above, the spreader assembly 14 comprises two elongate mandrels 30*a*, 30*b* which are joined at their forward ends by a hinge pin; in the embodiment which is illustrated, the second mandrel has a bifurcated forward end 120 which interfits with a single extension on the forward end 122 of the other mandrel 30*a* to form the vertically extending hinge joint.

The two leg members 34*a*, 34*b* of the mandrels extend rearwardly from the hinge joint. The inner edges of the leg members have a dogleg configuration, so that shoulder portions 124*a*, 124*b* extend inwardly near the forward ends thereof and meet along inner edges 126*a*, 126*b* which abut along the centerline of the system, thus acting as a stop to limit closure of the two mandrels. This arrangement renders it much easier for the operator to position the two mandrels in the correct initial orientation for engagement with the pressure assembly (e.g., see FIG. 3). The shoulder portions 124*a*, 124*b* terminate a sufficient distance forwardly of the recesses 36*a*, 36*b* to provide a gap 128 between the two leg members which is sufficiently wide to accommodate the cylinder portion 16 of pressure assembly 12.

The exterior portions of the two mandrels 30*a*, 30*b* are provided with smooth, rounded, elongate surfaces which are configured to conform generally to the interior surfaces of a shoe or boot. Thus, for example, in stretching a toe box as shown in FIG. 2, the two mandrels distribute the stretching force more or less evenly across the desired area, and avoid concentrations of pressure or abrasions which might lead to uneven shaping or damage to the interior of the shoe.

As was noted above, the width of the spreader assembly 14 is selectively adjustable to match varying width of shoes, by the attachment of cup-shaped overlay members. As is shown in FIG. 6, this is preferably accomplished by providing a series of attachable overlay members of increasing thicknesses.

Figure 6:
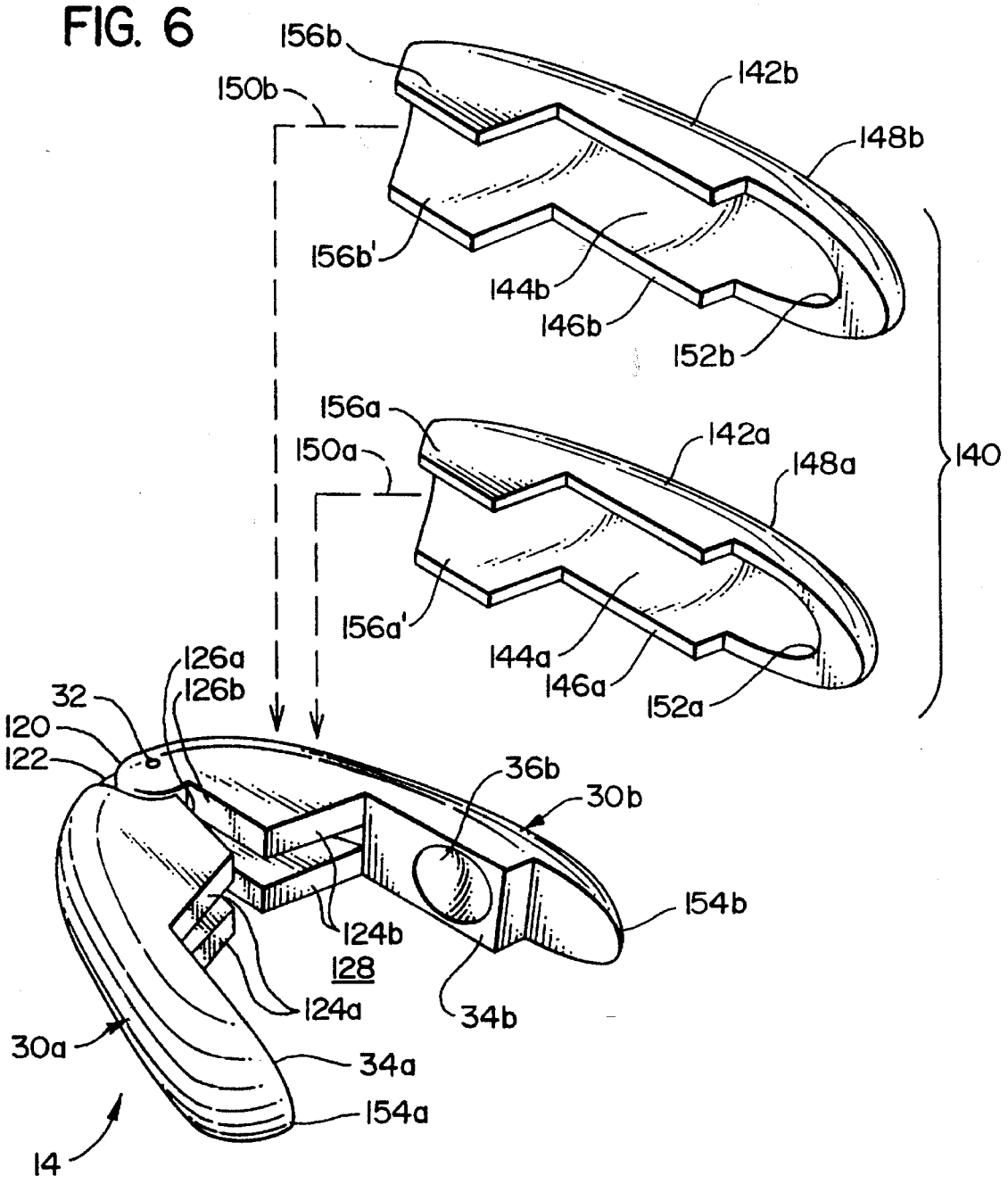
FIG. 6 is a perspective view of the hinged spreader assembly, showing this in an embodiment which is provided with a set of overlay members which have varying thicknesses and which are selectively mountable to the assembly so as to provide this with a width which generally matches that of the particular shoe with which the device is to be used.

In the embodiment which is illustrated in FIG. 6, the spreader assembly 14 is provided with a set 140 of overlay members of increasing thickness which are individually mountable to the mandrel member 30*b* of the spreader assembly (although not shown in FIG. 6, it will be understood that a corresponding set of overlay members is similarly provided for the opposite mandrel member 30*a*). Each set of shell members is provided with outer surfaces (e.g., 142*a*, 142*b*, etc.) and contours which correspond to those of the underlying mandrels 30*a*, 30*b*, i.e., the outer surface are smoothly contoured so as to generally conform to the internal surfaces of the shoe. The concave inner surfaces of the shell members, in turn, are configured to conform to and frictionally engage the contoured outer surfaces of the underlying mandrels 30*a*, 30*b* (e.g., see inner surfaces 144*a*, 144*b* in FIG. 6). This renders it very convenient for the operator to select one or more shell members which in combination will provide the spreader assembly with a width which generally matches that of the shoe, and to fit these quickly and easily to one or both of the mandrels.

In order to enhance the frictional engagement of the shell members with the underlying mandrels, the concave internal surface of each shell member is preferably sized to have a radius a few thousandths of an inch smaller than that of the exterior surface which it is intended to engage (i.e., there is a slight negative allowance between the two), so that a slight interference fit is formed between the two parts when they are pressed together by hand. Also, the material of which the mandrels and shell members are formed—injected molded plastic, hard rubber, metal, and similar materials, for example—is preferably selected, and also provided with suitable surface texturing, to have a relatively high static coefficient of friction and a relatively low sliding coefficient of friction so as to ease assembly but still provide a firm engagement once the parts have been pressed into the desired position.

The average thickness of the overlay wall 146*a*, 146*b* increases progressively from one member to the next throughout the set, so that each thicker-sized overlay positions the outer surface 148*a*, 148*b* a predetermined distance further outwardly from the centerline between the two mandrels, thereby increasing the overall width of the spreader assembly.

As can also be seen in FIG. 6, the shell members extend over roughly 80–90% of the length of the underlying mandrel members, but stop short of the forward end thereof, and the forward ends of the shell members taper to a relatively thin thickness while the rearward edges are relatively thick; this configuration permits the forward end of the built-up assembly, adjacent the hinge joint, to fit closely within the interior contours of the toe box (e.g., see FIG. 2), and also (as will be discussed in greater detail below) helps the spreader assembly to be slid into the end of the shoe without the leading edges of the shell members catching on the interior surface of the shoe and becoming displaced.

Thus, by selecting the overlay member having the desired thickness, the operator can adjust the overall width of the spreader assembly to correspond to that of the particular shoe being worked on. For example, in a relatively narrower shoe, the relatively thinner shell member 142*a* can be selected and mounted to the corresponding mandrel member 30*b*, as indicated by a dotted line arrow 150*a*. Similarly, for a relatively wider shoe, the relatively thicker overlay shell 142*b* is selected and mounted to the mandrel member, as indicated by dotted line arrow 150*b*. In order to assist the operator in making the selection of the correct overlay, each of the shells in the set 140 (i.e., 142*a*, 142*b* . . .) may be marked with a suitable legend indicating the size/width of the shoe. Also, as was noted above, the complete set will ordinarily comprise a plurality of overlay shell members for both of the mandrels 30*a*, 30*b* of the spreader assembly.

In the embodiment which is illustrated, the spreader assembly may have the following exemplary dimensions:

| | |
|---|---|
| overall width (closed position) | 2-⅞ inches |
| overall height | ⅞ inch |
| medial mandrel, length | 3-¼ inches |
| lateral mandrel, length | 3-⅞ inches |
| axis of pivot pin | approximately centerline, ⅜ inch from toe end |
| width of gap between inner surfaces of leg members (closed position) | 1-11/16 inches |
| diameter of ball and socket recesses (matched to hemispherical ends of piston members) | ⅝ inch |
| radius of hemispherical recesses (matched to hemispherical ends of piston members) | 11/16 inch |
| medial overlay (first (size) overall length | 3-⅛ inches |
| medial overlay (first size), average thickness | 1/16 inch |
| medial overlay (first size) thickness at trailing edge | ¼ inch |
| lateral overlay (first size), overall length | 3-⅝ inches |
| lateral overlay (first size) average thickness | 1/16 inch |
| lateral overlay (first size) thickness at trailing edge | ¼ inch |
| medial overlay (second size) overall length | 3-5/16 inches |
| medial overlay (second size), average thickness | ⅛ inch |
| medial overlay (second size) thickness at trailing edge | 5/16 inch |
| lateral overlay (second size), overall length | 3-13/16 inches |
| lateral overlay (second size), average thickness | ⅛ inch |
| lateral overlay (second size), maximum thickness at trailing edge | 5/16 inch |

A spreader assembly having the dimensions listed above has proven suitable for stretching men's street shoes in the more common widths; it will be understood, however, that while two shell members have been described for purposes of illustration, a complete set may comprise as many overlay members as is needed or desired to achieve the desired range of widths and gradations thereof. Furthermore, it will be understood that these dimensions are only exemplary in nature and may be varied as desired for any particular application; for example, women's or children's shoes may call for assemblies having significantly smaller dimensions.

Figure 7:
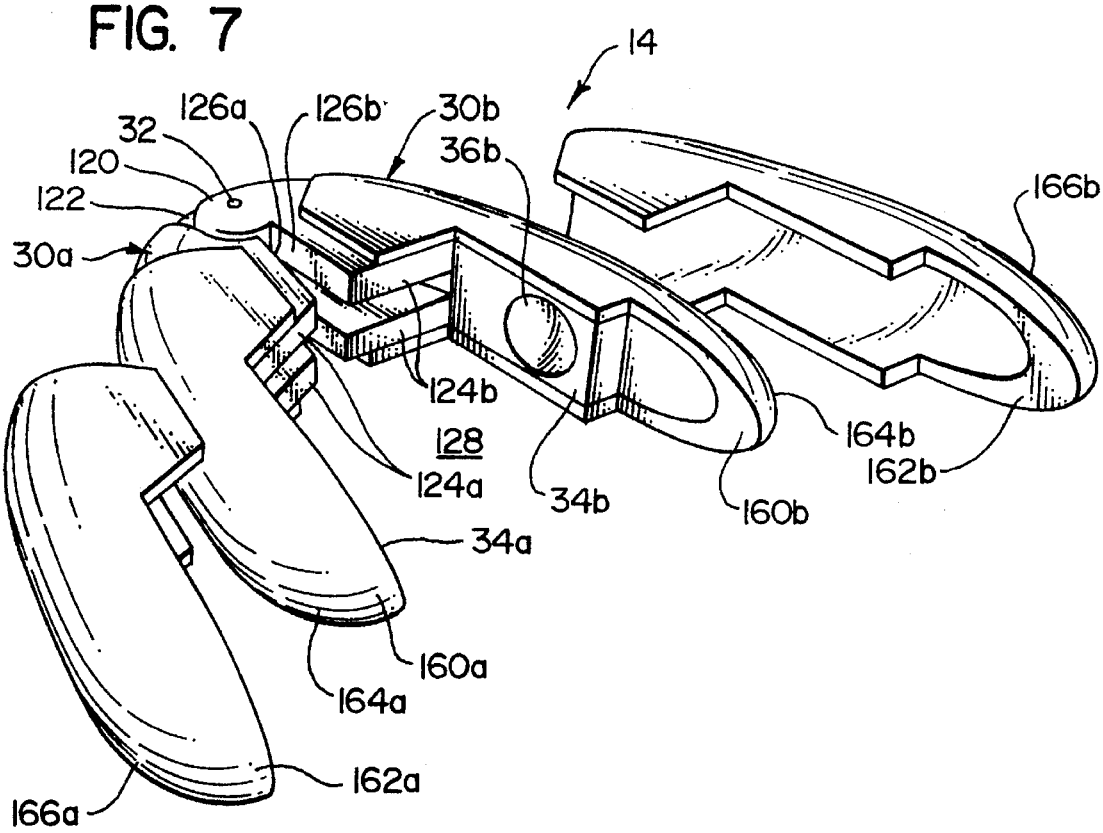
FIG. 7 is a perspective view of the hinged spreader assembly, showing this in a second embodiment which is provided with nesting overlay members which are selectively mountable to the assembly so as to build this up to a width which generally matches that of the particular shoe with which the device is to be used.
Figure 8:
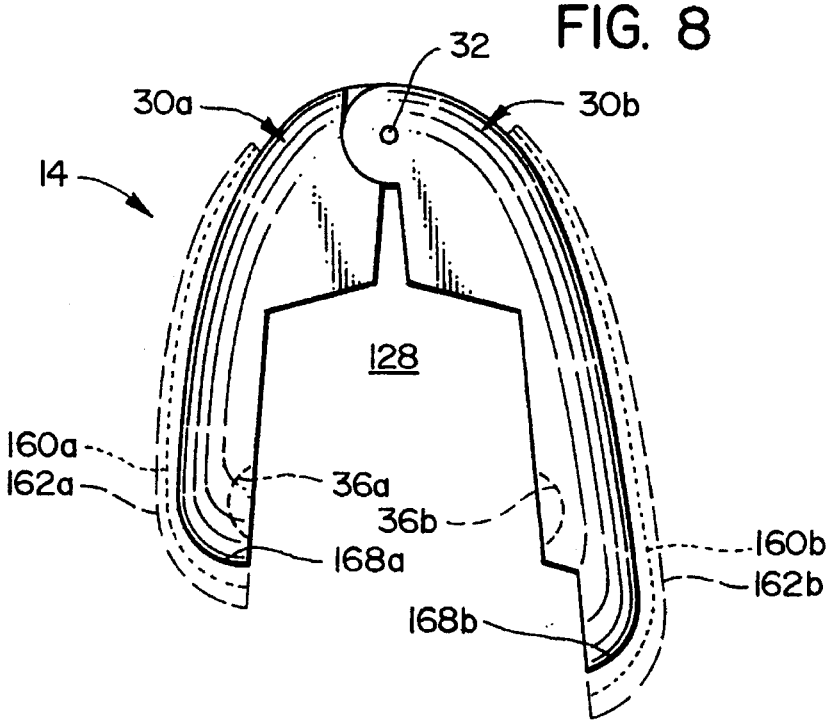
FIG. 8 is a plan view of the spreader assembly of FIG. 7, showing the overlay members in a dotted line image.

FIGS. 7 and 8 illustrate a second embodiment of spread assembly, in which the assembly 14 is provided with a series of semi-concentric, nesting shell members which fit over the leg portions of the two mandrel members so as to effectively increase the size thereof to match the interiors of various sizes of shoes. For example, FIG. 7 shows a first set of shell members 160*a*, 160*b* which are fitted over the leg portions 34*a*, 34*b* of mandrels 30*a*, 30*b*, and a second set of shell members 162*a*, 162*b* which in turn are configured to fit over the first set. Thus, by assembling the shell members in the manner shown in FIG. 8, the operator can "build up" the width of the assembly to match that of the interior of the selected shoe; in other words, for a narrower shoe the bare mandrel members of the spreader assembly may suffice, whereas a wider shoe may require the addition of one or several shell members on one or both sides of the assembly.

As was noted above, the exemplary spreader assemblies 14 which are shown in these figures, are particularly configured to stretch the toe box portion of a shoe, which is perhaps the most commonly needed adjustment. Accordingly (looking downwardly on the assembly), the medial mandrel member 30*a* is relatively short and strongly curved, so as to correspond to the general outline of the person's foot as traced from a point forwardly of the second phalange and back past the tip of the first phalange (i.e., the big toe) to about the first metatarsal head; the lateral mandrel member 30*b*, in turn, is somewhat longer and less strongly curved, thereby corresponding to the general outline of a person's foot from about the tip of the second or third toe back to the fifth metatarsal head, the latter being positioned somewhat more toward the rear of the foot than the first metatarsal head. Because the outline of the assembly thus corresponds to the proper shape of a normal foot, the assembly serves to stretch the walls of the toe box to a contour which will comfortably and properly accommodate the same. As was noted above, the spreader assembly can be inverted or "flipped over" for use in either right foot or left foot applications. It will be understood, however, that the spreader assembly may be configured to engage and stretch other selected parts of the shoe as desired.

The assembly may be formed of any suitable material, although injection-molded plastic is perhaps most preferable from the standpoint of economy of manufacture.

c. Operation

The typical operation of the present invention will now be described in detail, with reference to the embodiment which is disclosed herein, and particularly referring to the embodiment of spreader assembly which is illustrated in FIG. 6.

In preparation for use of the system, the operator first charges the pressure assembly with the hydraulic fluid, which is preferably ordinary tap water. The operator then proceeds to adjust the width of the spreader assembly to match that of the article of footwear which is to be stretched. For example, with regard to the embodiment which is illustrated, the operator slides the spreader assembly into the toe box of the shoe or boot and checks it for tightness of fit. If additional width is needed, then suitable overlay shell members are selected and pressed against the outer surfaces of the mandrels so as to build the assembly up to the correct width.

In mounting the overlay members to the mandrels, the operator positions the overlay shell somewhat rearwardly and to the outside of the mandrel member, and then presses the two together with a longitudinal sliding motion until the cupped trailing edge portion 152 of the overlay comes into abutment with the blunt end 154 of the mandrel (see FIG. 6), the engagement between the two acting as a stop to arrest relative movement of the parts once the correct alignment has been achieved. This motion also takes advantage of the relatively low coefficient of sliding friction of the material, rendering it easier for the operator to slide the overlay member quickly and smoothly into place. Moreover, in the final stages of this motion, the upper and lower flange portions 156*a*, 156*a'*, 156*b*, 156*b'* slide into position over the inwardly extending shoulder portions 124 of the mandrels, thereby greatly increasing the surface area engagement between the two members. This increased surface area contact, in combination with the relatively high coefficient of static friction of the material, renders the overlay member very resistant to sliding off of the mandrel in a longitudinal direction. This allows the operator to quickly and easily slide the spreader assembly into the toe box without fear of the overlay members slipping off as they rub against the inner surface of the shoe; the likelihood of this happening is further reduced by the tapering of the leading edge of the overlay shell, which minimizes any protrusion of the joint which might otherwise catch against the interior of the shoe. However, although it is exceedingly difficult to slide the overlay off of the mandrel in a longitudinal direction, disassembly is very easily affected when desired, by simply grasping the upper and lower flange portions 156 between the thumb and forefinger and pulling these outwardly (i.e., in a lateral direction) with a slight pivoting motion so as to free the two members.

With the spreader assembly prepared, the operator positions the transversely extending cylinder portion of the pressure assembly in the gap 128 between the two mandrels and locates the hemispherically domed surfaces on the ends of the piston members in the corresponding receptacles to form the ball and socket engagement. With the two assemblies held together in this position, the operator then slides the spreader assembly into the toe box of the shoe, at which point the operating knob of the pressure assembly is located adjacent the ankle opening. The operator rotates the knob so as to force the piston members outwardly in opposite directions, spreading apart the mandrels and stretching the toe box by the desired amount. During the process, the device can be removed so that the customer can try on the shoe and determine whether further stretching is required.

Having described the present invention in its preferred embodiments, many obvious variations thereon and modifications thereto will occur to those skilled in the art. Accordingly, the present invention is not to be limited except as by the appended claims.

What is claimed is:

1. An apparatus for internally expanding an article of footwear, said apparatus comprising:

(a) a pressure assembly comprising:

a fluid pressure cylinder portion;

a piston member mounted in said cylinder portion for reciprocation therein;

a first engagement member formed on an outer end of said piston member;

a second engagement member formed on a side of said cylinder portion opposite said first engagement member so as to be spaced apart therefrom by a predetermined separation distance; and means for supplying fluid pressure to said cylinder portion so as to selectively extend said piston member; and (b) a spreader assembling comprising:

first and second mandrels for engaging first and second sides of a selected interior portion of said article of footwear, said mandrels comprising rearwardly extending leg members;

hinge means for joining said first end portions of said leg members proximate a first end of said spreader assembly so that said leg members extend therefrom to form a gap intermediate second ends of said leg members; and receptacle portions formed in said second end portions of said leg members so as to be positioned on opposite sides of said gap for receiving said first and second engagement portions on said cylinder portion of said pressure assembly;

whereby, in response to selectively supplying fluid pressure to said cylinder portion, said at least one piston member extends therefrom so as to increase said separation distance by which said first and second engagement portions on said pressure assembly are spread apart, so that said engagement members which are received in said receptacle portions of said first and second leg members force said mandrels outwardly about said hinge means so as to internally expand said selected portion of said article of footwear.

2. The apparatus of claim 1, further comprising:

bearing means for permitting pivoting movement of said leg members of said spreader assembly relative to an axis of said cylinder portion of said pressure assembly as said mandrels spread apart therefrom.

3. The apparatus of claim 2, wherein said bearing means comprises:

a bearing interface formed between at least one said engagement member on said pressure assembly and said receptacle portion in said leg member of said spreader assembly in which said engagement member is received.

4. The apparatus of claim 3, wherein said bearing interface comprises:

a smooth, convex, generally hemispherical surface formed on an outer end of said piston member; and a smooth, concave, generally hemispherical surface formed in said receptacle portion of said leg member.

5. The apparatus of claim 4, wherein said pressure assembly further comprises:

a second piston member mounted in said cylinder portion for reciprocation therein in a direction opposite that of said first piston member, said second piston member having said second engagement member formed on an outer end thereof.

6. The apparatus of claim 5, wherein said means supplying pressure to said cylinder portion comprises:

a hydraulic fluid reservoir;

piston means for selectively displacing said hydraulic fluid out of said reservoir under pressure; and a conduit for supplying said hydraulic fluid which is forced out of said reservoir to said cylinder portion so that said piston members are selectively forced outwardly thereby.

7. The apparatus of claim 6, wherein said hydraulic fluid reservoir comprises:

a substantially cylindrical chamber having a long axis along which said piston means travels so as to displace said fluid from said chamber.

8. The apparatus of claim 7, wherein said pressure assembly further comprises:

an elongate handle portion which encloses said hydraulic reservoir and extends generally perpendicularly from said cylinder portion of said pressure assembly so as to form a hand grip which assists an operator in holding said assembly.

9. The apparatus of claim 8, wherein said piston means for selectively displacing said hydraulic fluid out of said reservoir comprises:

an elongate threaded member having an inner end mounted to a drive piston in said cylindrical chamber, and an outer end which extends axially from a rearward end of said elongate handle portion and is in threaded engagement therewith; and a knob member mounted to said outer end of said elongate threaded member, said knob member being configured to permit an operator to selectively displace said hydraulic fluid out of said reservoir by rotating said knob member with the fingers of a first hand while holding said handle portions with the fingers of a second hand.

10. The apparatus of claim 9, wherein said handle portion is sized to have sufficient length to extend from proximate said selected interior portion of said article of footwear to proximate an ankle opening thereof, so as to enable an operator to rotate said knob member with a hand which extends into said ankle opening.

11. The apparatus of claim 10, wherein said handle portion further comprises a neck portion interconnecting said hand grip portion and said cylinder portion so as to provide said handle portion with said sufficient length; and said conduit for said fluid comprises an elongate bore extending substantially coaxially from said cylindrical reservoir chamber and through said neck portion to said cylinder member.

12. The apparatus of claim 5, wherein each said leg member of said first and second mandrels comprises:

an inner surface having said receptacle portion formed therein; and a generally smooth, convex outer surface which is configured to engage a correspondingly-shaped inner surface of said selected interior portion of said article of footwear.

13. The apparatus of claim 12, wherein at least one said mandrel further comprises:

at least one overlay member which is configured to be selectively fitted over said outer surface of said leg member of said mandrel so as to selectively increase an effective size of said mandrel.

14. The apparatus of claim 13, wherein said at least one overlay member comprises:

an elongate, cupped shell member having a predetermined thickness, said shell member having:

(a) a concave inner surface which corresponds to and detachably engages said smooth, convex outer surface of said leg member; and (b) a generally smooth, convex outer surface which is configured to engage a correspondingly-shaped inner surface of a selected portion of a second article of footwear having an interior width which corresponds to said increased effective size of said mandrel.

15. The apparatus of claim 14, wherein said concave inner surface of said shell member has an inner radius which is slightly smaller than an outer radius of said convex outer surface of said leg member so that said shell member frictionally engages said outer surface of said leg member when fitted thereover.

16. The apparatus of claim 14, wherein said at least one overlay member further comprises:

a second elongate, capped shell member having a predetermined thickness, said second shell member having:

(a) a concave inner surface which corresponds to and detachably engages said convex outer surface of said first shell member; and (b) a generally smooth, convex outer surface which is configured to engage a correspondingly-shaped inner surface of a side of an interior portion of a third article of footwear gear having a larger interior width than said second article of footwear.

17. The apparatus of claim 16, wherein said first and second mandrels each comprise an overlay member comprising a plurality of said shell members, said shell members in combination providing said spreader assembly with a selectively adjustable range of widths which corresponds to a plurality of articles of footwear having a predetermined range of widths.

18. The apparatus of claim 5, wherein said hinge means comprises:

first and second lug portions extending from said first end portions of said first and second leg members, respectively; and a hinge pin extending through said lug portions so as to permit said first end portions of said leg members to pivot relative to one another about an axis of said hinge pin.

19. The apparatus of claim 5, wherein said selected interior portion of said article of footwear is a toe box thereof, and said mandrel members are shaped to correspond to and engage first and second sides of said toe box with said hinge means positioned proximate a toe end thereof.

20. The apparatus of claim 10, wherein said hydraulic fluid is tap water.

* * * * *